US008040209B2

(12) United States Patent
Faik et al.

(10) Patent No.: US 8,040,209 B2
(45) Date of Patent: Oct. 18, 2011

(54) DIVIDED ADJUSTABLE ARMATURE FOR A CIRCUIT BREAKER

(76) Inventors: Salaheddine Faik, Marion, IA (US); Dennis W Fleege, Cedar Rapids, IA (US)

( * ) Notice: Subject to any disclaimer, the term of this patent is extended or adjusted under 35 U.S.C. 154(b) by 0 days.

(21) Appl. No.: 12/701,305

(22) Filed: Feb. 5, 2010

(65) Prior Publication Data

US 2010/0188176 A1 Jul. 29, 2010

Related U.S. Application Data

(63) Continuation of application No. 11/982,832, filed on Nov. 5, 2007, now abandoned.

(51) Int. Cl.

| | |
|---|---|
| ***H01H 75/10*** | (2006.01) |
| ***H01H 77/06*** | (2006.01) |
| ***H01H 81/04*** | (2006.01) |
| ***H01H 9/00*** | (2006.01) |

(52) U.S. Cl. ..... 335/42; 335/172; 335/176

(58) Field of Classification Search ..... 335/172, 335/176, 35–48

See application file for complete search history.

(56) References Cited

U.S. PATENT DOCUMENTS

| | | | | |
|---|---|---|---|---|
| 2,590,663 | A * | 3/1952 | Walker | 335/37 |
| 2,679,562 | A * | 5/1954 | Drobney et al. | 335/37 |
| 3,317,867 | A * | 5/1967 | Powell | 335/37 |
| 3,815,064 | A * | 6/1974 | Maier et al. | 335/176 |
| 4,231,006 | A * | 10/1980 | Belttary | 335/36 |
| 4,266,105 | A * | 5/1981 | Perkins, Jr. | 200/50.1 |
| 4,284,968 | A * | 8/1981 | Denoyelle et al. | 335/176 |
| 4,691,182 | A * | 9/1987 | Mrenna et al. | 335/176 |
| 4,719,438 | A * | 1/1988 | Mrenna et al. | 335/38 |
| 4,958,136 | A * | 9/1990 | Maier et al. | 335/42 |
| 5,381,120 | A * | 1/1995 | Arnold et al. | 335/35 |
| 5,831,499 | A * | 11/1998 | Batteux et al. | 335/9 |
| 6,054,912 | A * | 4/2000 | Kaneko et al. | 335/172 |
| 6,104,273 | A * | 8/2000 | Larranaga et al. | 337/82 |
| 6,218,920 | B1 * | 4/2001 | Reichard et al. | 335/176 |
| 6,407,653 | B1 * | 6/2002 | Zindler et al. | 335/6 |
| 6,788,174 | B1 * | 9/2004 | Afshari et al. | 335/42 |
| 6,794,963 | B2 * | 9/2004 | O'Keeffe et al. | 335/21 |
| 2001/0045879 | A1 * | 11/2001 | Reichard et al. | 335/172 |
| 2003/0197581 | A1 * | 10/2003 | O'Keeffe et al. | 335/172 |
| 2008/0122563 | A1 * | 5/2008 | Song | 335/176 |

* cited by examiner

*Primary Examiner* — Elvin G Enad
*Assistant Examiner* — Alexander Talpalatskiy

(57) ABSTRACT

A divided armature for the trip mechanism of a circuit breaker especially useful for low trip current breakers allows for two independent adjustments: first of the magnetic air gap between the yoke and the armature and second of the clearance between the trip bar and the back plate of the armature. The divided armature allows the force of a return spring of the trip mechanism to be unchanged while adjusting the magnetic air gap to set the trip current point.

19 Claims, 9 Drawing Sheets

DIVIDED ADJUSTABLE ARMATURE FOR A CIRCUIT BREAKER

RELATED APPLICATIONS

This application is a Continuation of, and claims priority to, U.S. application Ser. No. 11/982,832, filed Nov. 5, 2007 now abandoned.

BACKGROUND OF THE INVENTION

1. Field of the Invention

The present invention relates generally to electromagnetic actuators and more specifically to actuators such as trip mechanisms found in circuit breakers, accessories of circuit breakers, relays, or actuators.

2. Discussion of the Related Art

Referring to FIG. 1, in a known armature-yoke system 11, the input current in a conductor (not shown) within the yoke 13 creates a magnetic field in the yoke 13, the armature 14 and the magnetic air gap (g) between them. This results in a magnetic torque that rotates the armature 14 towards the stationary yoke 13 and moves the trip bar 16. The hammer 18 is then released and strikes a target device, e.g. a breaker latch release (not shown), as is understood by those in the art.

The magnetic torque on the armature 14 is adjusted by turning a screw 20 to set the magnetic air gap (g). The smaller the magnetic air gap (g) the higher the magnetic torque. However, as the armature 14 moves closer to the yoke 13, the force of the return spring 22, attached to the bell crank 24 for resetting the armature 14, also increases, thus counteracting the effect of the magnetic torque. The net result is a reduced sensitivity of the system to gap adjustment and a lower net torque on the armature 14. This may not be desirable in applications where the input current is low.

SUMMARY OF THE INVENTION

In one embodiment of the present invention a divided adjustable armature for the trip mechanism of a circuit breaker allows for two independent adjustments: first, of the magnetic air gap (g) between the yoke and the armature and second, of the clearance (c) between the trip bar and the back plate of the armature, thus allowing the mechanical spring force of the trip mechanism to be unchanged while adjusting the magnetic gap to set the trip current point. The performance of electromagnetic actuators can thus be enhanced by increasing their response to magnetic air gap adjustment. This allows a circuit breaker trip mechanism to use a reduced level of trip current or achieve a wide range of armature torque, or both. Thus, the present invention is especially useful for low trip current breakers.

In a typically known magnetic tripping system, such as discussed above, the reduction in armature to yoke gap (g) is accompanied by an increase in the force of the mechanical spring 22 applied to the armature 14, here through bell crank 24, thus reducing the net torque applied to the armature 14 and resulting in a flat response. The present invention can increase the sensitivity of electromagnetic actuators to electric current and eliminate the flat spot found in the curve of trip current versus magnetic air gap for known tripping systems.

Also in the known system, the clearance (c) between the armature 14 and the trip bar 16 changes, making the system response non-linear and calibration difficult. The present invention eliminates this interdependence by allowing adjustment of the magnetic air gap (g) without altering the clearance (c) or the tension of the armature return spring 22.

In one embodiment of the present invention a circuit breaker has a trip assembly with an armature electromagnetically attractable to a yoke, whereby the armature can be driven towards the yoke to release a trip bar. The trip assembly also has a return spring operably interacting with the armature for resetting the trip assembly. The armature of the trip assembly is divided, with a ferromagnetic front plate having a surface facing towards the yoke and a back plate adjustably settable in a fixed position relative to the front plate whereby the back plate can impinge on the trip bar to initiate the opening of a circuit. A first adjustment linkage is included for adjustably setting a magnetic air gap between the yoke and the front plate without material effect on the operating tension of the return spring. A second adjustment linkage for adjustably setting a relative position between the back plate and the trip bar is further included.

In some embodiments of the invention the front plate and the back plate of the divided armature are kept rigidly attached together by means of a first screw and an anti-backlash set screw. The back plate to trip bar clearance can be adjusted with a second screw independently of the magnetic air gap. Thereby adjustment of the magnetic air gap via the first screw does not affect the armature return spring tension and adjustment of the magnetic air gap does not affect the clearance between the back-plate and the trip bar. Thus the present invention can provide higher sensitivity of the net armature torque to magnetic air gap adjustment, higher response of trip current to magnetic air gap adjustment, a higher range of tripping current adjustment, a very low end tripping current and a very linear response of tripping current to the magnetic air gap adjustment.

In still other embodiments a circuit breaker according to the present invention may have a trip assembly with an armature electromagnetically attractable to a yoke, whereby the armature can be driven towards the yoke to release a trip bar, and with a return spring for resetting the trip assembly. The trip assembly can comprise a divided armature on a mounting plate included within the trip assembly, the divided sections being a ferromagnetic front plate having a surface facing towards the yoke and a back plate attached to the front plate opposite the surface facing toward the yoke, for impinging on a trip bar to initiate the opening of a circuit. A first adjustment screw can be included between the front plate and the back plate for adjustably setting a magnetic air gap between the yoke and the front plate; and a second adjustment screw can be included between the back plate and the mounting plate for adjustably setting a clearance between the back plate and the trip bar.

Thus, an adjustment of the first screw will not materially affect the operating tension of the return spring. In some embodiments this circuit breaker may include an antibacklash set screw between the two armature pieces for fixing the distance therebetween. In some embodiments this circuit breaker may be arranged whereby the front plate threadably receives the first adjustment screw which is contained within the back plate for setting the clearance between the back plate and the front plate. In some embodiments this circuit breaker may be arranged whereby the second adjustment screw is threaded through the mounting plate and impinges on the back plate for setting the clearance between back plate and a trip bar.

DETAILED DESCRIPTION

Figure 1:
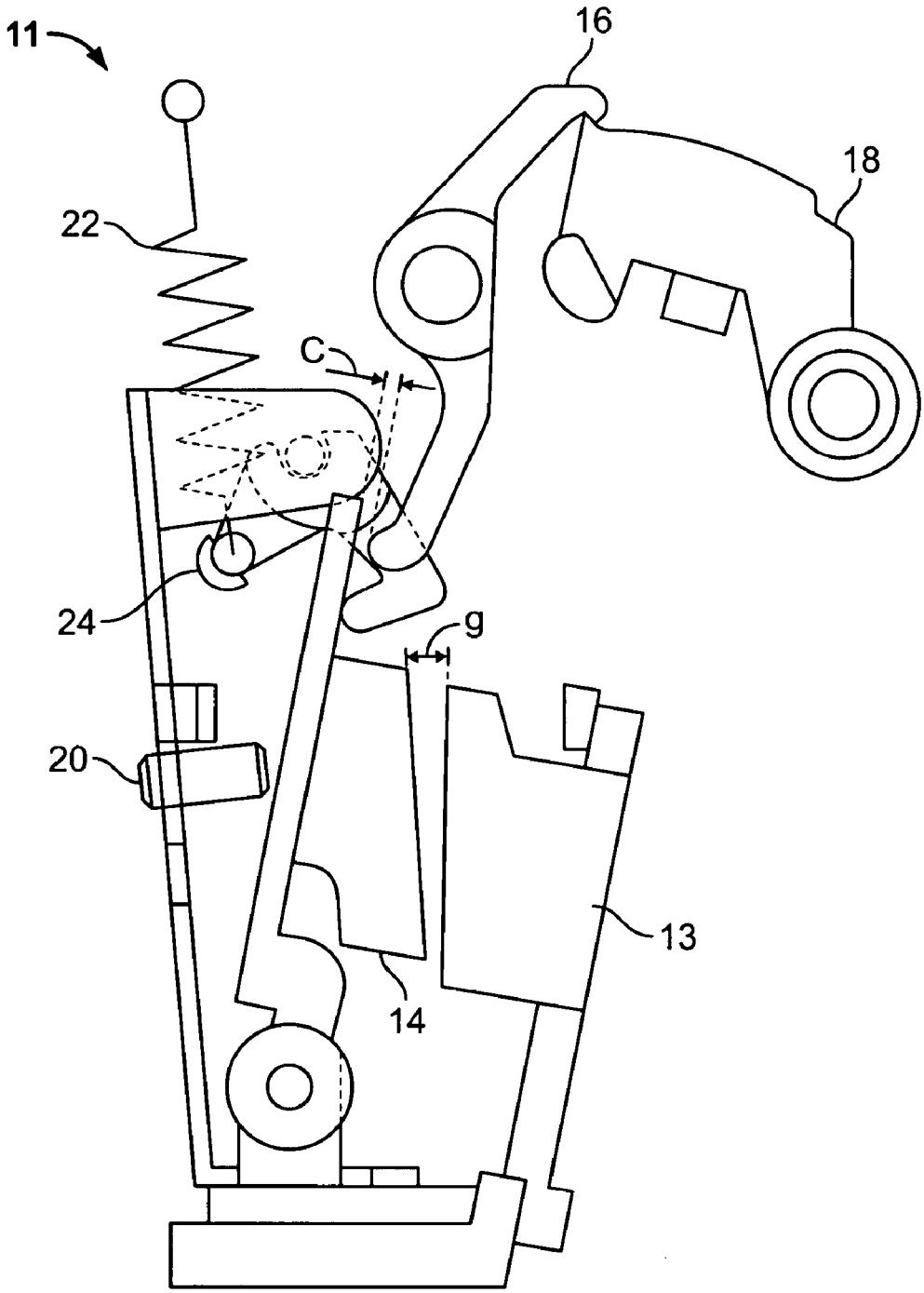
FIG. 1 illustrates a known tripping system according to the prior art.
Figure 2:
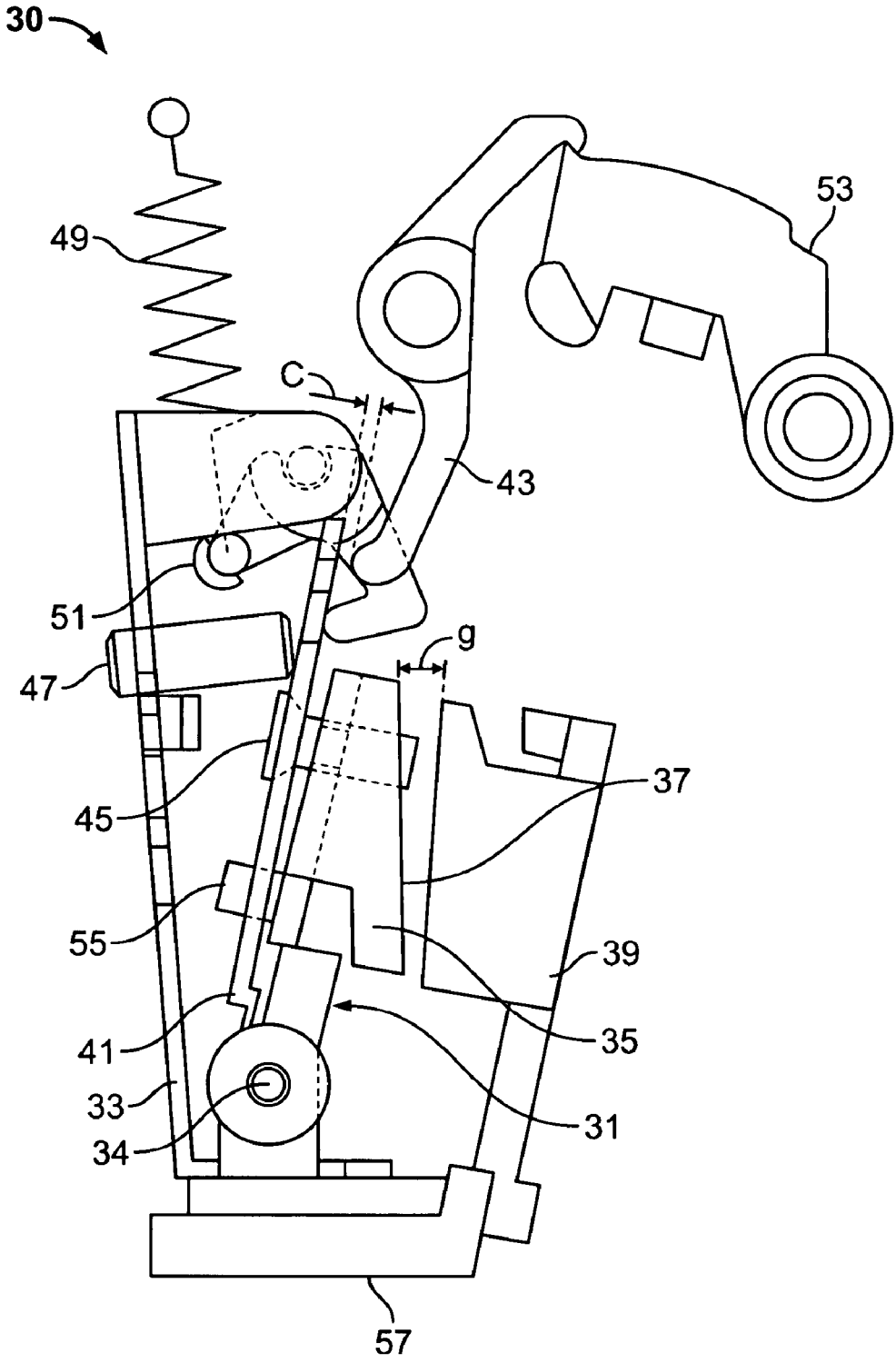
FIG. 2 illustrates a first embodiment of a tripping system according to the present invention.

As seen in FIG. 2, a trip assembly 30 according to the present invention for a circuit breaker having a trip assembly, includes a divided armature 31 on a mounting plate 33 included within the trip assembly 30. Two sections of the divided armature 31 are a ferromagnetic front plate 35 having a surface 37 facing towards the yoke 39 and a back plate 41 attached, or settable in a fixed position relative to, the front plate 35 opposite the surface 37 facing toward the yoke 39. The back plate 41 can impinge on a trip bar 43 to initiate the opening of a circuit. A first adjustment linkage, represented by the first screw 45 between the front plate 35 and the back plate 41, rotates for adjustably setting the distance between the two plates and thereby setting a magnetic air gap "g" between the yoke 39 and the front plate 35. A second adjustment linkage, represented by screw 47 between the back plate 41 and the mounting plate 33, rotates for adjustably setting a clearance "c" between the back plate 41 and the trip bar 43. An adjustment of the first screw 45 does not materially affect the operating tension of the armature return spring 49 applied to the armature 31, here through a bell crank 51 to which the return spring 49 is attached.

Electric current flowing in a conductor (not shown) inside the yoke 39 creates a magnetic field that results in the ferromagnetic front plate 35 of the armature 31 being attracted towards the yoke 39. The armature 31 carries the back plate 41 that eventually hits the trip bar 43. Back plate 41 can be made of a nonmagnetic material. When the trip bar 43 has rotated sufficiently, the hammer 53 is released to strike a breaker delatching mechanism (not shown) as will be understood by those in the art. The return spring 49 returns the trip unit to its initial position through the bell crank 51 in contact with the back plate 41. By adjusting the magnetic air gap (g), the armature torque and therefore the tripping current setting can be controlled.

This adjustment is carried out by first loosening an anti-backlash set screw 55 and then turning the first screw 45 in or out to vary the magnetic air gap (g). This change in magnetic air gap does not affect the trip bar clearance (c) or the tension of the return spring 49. Consequently, the change in the magnetic torque is not offset by a change in the spring force. The result is a better system response and greater range of tripping current settings. The set screw 55 is then retightened to eliminate any backlash between the front plate 35 and the back plate 41.

Prior to performing the magnetic air gap adjustment, the trip bar clearance (c) is set by adjusting the second screw 47 anchored in the mounting plate 33 and extending towards the back plate 41. An armature pivot 34 serves as a fixed base for the armature sub-assembly. The front plate 35, the back plate 41 and the bell crank 51 are all hinged on the mounting plate 33. The second screw 47 is threaded through the mounting plate 33. The trip assembly housing 57 is typically the structure to which all the other parts are anchored.

Figure 15:
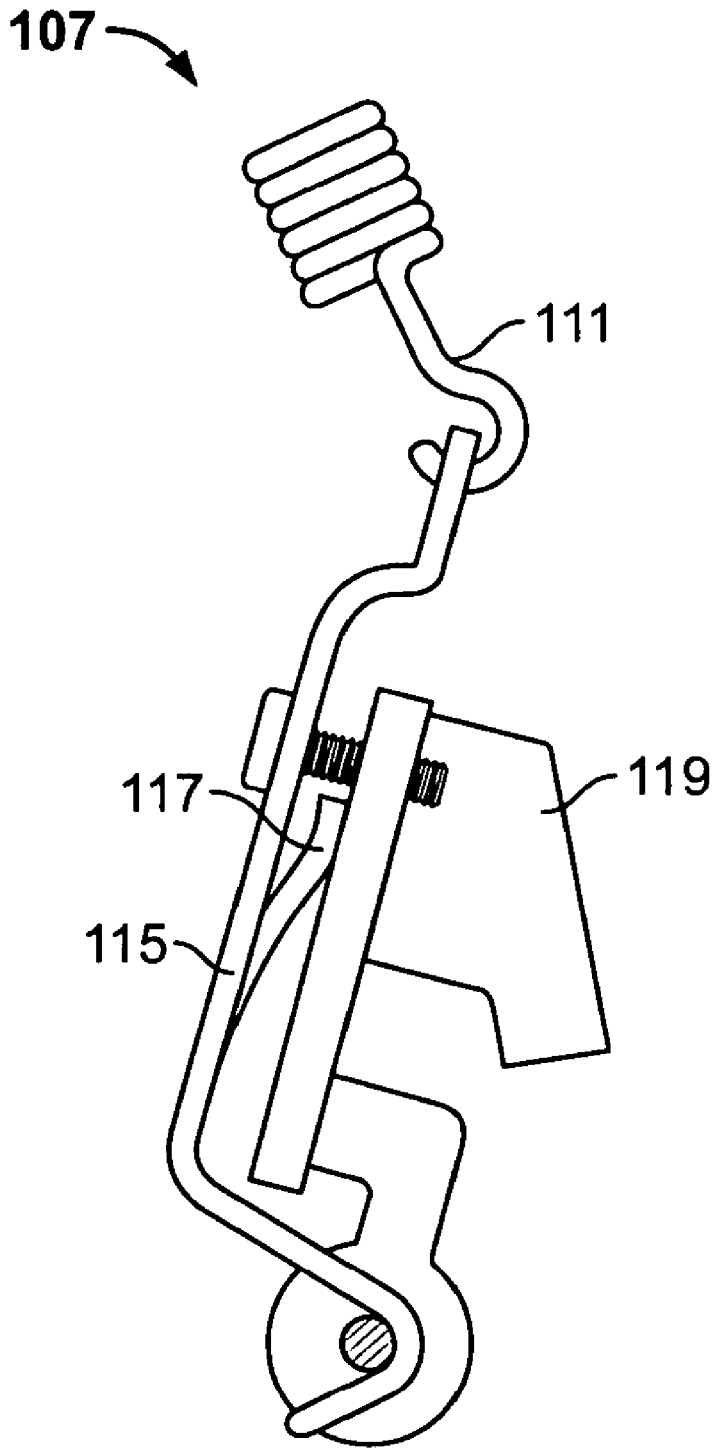
FIG. 15 shows an embodiment where the return spring acts directly on the armature.

It will be appreciated that within the practice of the present invention many variations may occur, such as the set screw 55 can be replaced by another means to eliminate backlash between the front plate 35 and the backplate 41. Further alternatives may include spring elements which can be used to perform the function of the backplate 41 and the set screw 55 and also keep the divided plates of the armature pre-loaded as further discussed below. In some embodiments the front plate and the back plate of the armature may be formed from a single piece flexure, as further discussed below. It will also be appreciated that the same principle of a divided armature can be applied to a system where the armature return spring acts directly on the backplate with the bell crank removed as seen in FIGS. 15 and 16.

Figure 3:
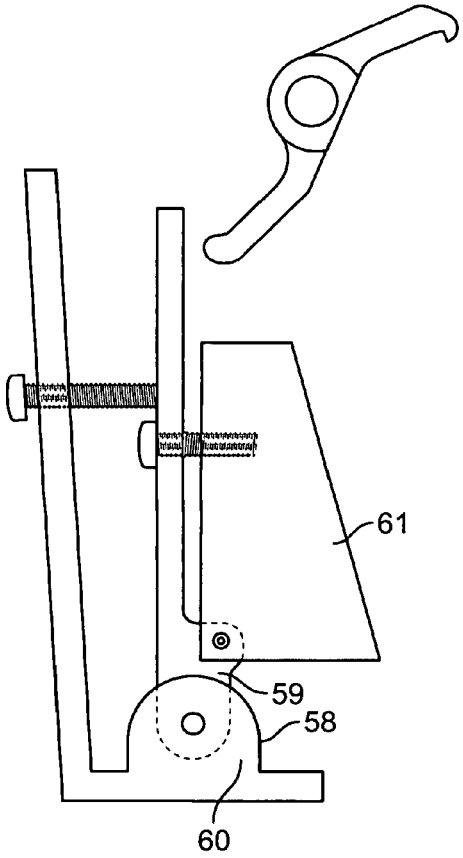
FIG. 3 illustrates an embodiment where the two armature sections are not hinged about the same pivot.

Referring to FIG. 3, in this embodiment, the two armature pieces are not hinged about the same pivot. Instead the back plate 59 pivots on a boss 58 of the mounting plate 60 and the front plate 61 pivots on a boss of the back plate 59 formed for this purpose.

Figure 4:
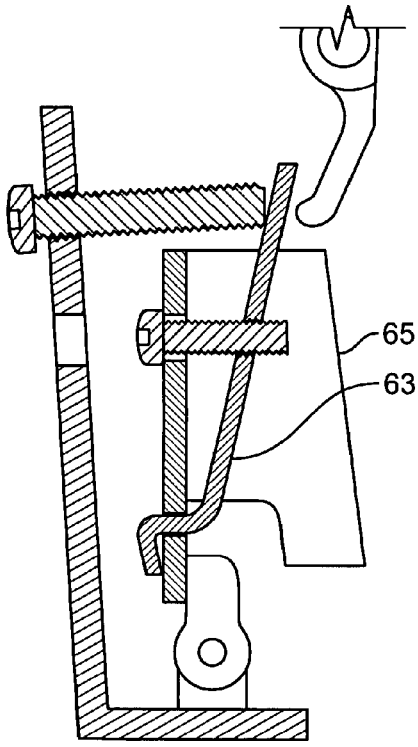
FIG. 4 shows an alternate construction where the back plate is a spring element mounted inside a formed front plate of the armature.
Figure 5:
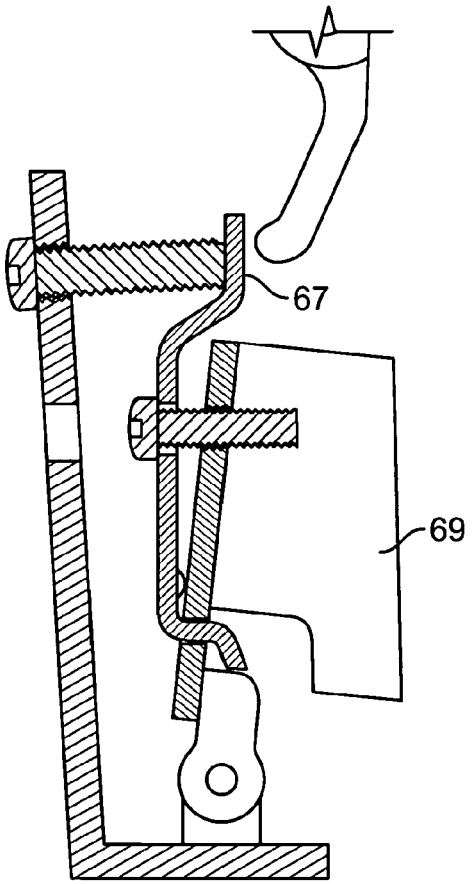
FIG. 5 is an alternate construction with the back plate/spring element mounted on the exterior of the front plate of the armature.

Referring to FIG. 4 there is shown an alternate construction where the back plate 63 is a spring element mounted inside the front plate 65 of the armature thereby eliminating the need for the set screw 55 of FIG. 2. FIG. 5 is an alternate construction whereby the spring element back plate 67 is mounted on the exterior of the front plate 69.

Figure 6:
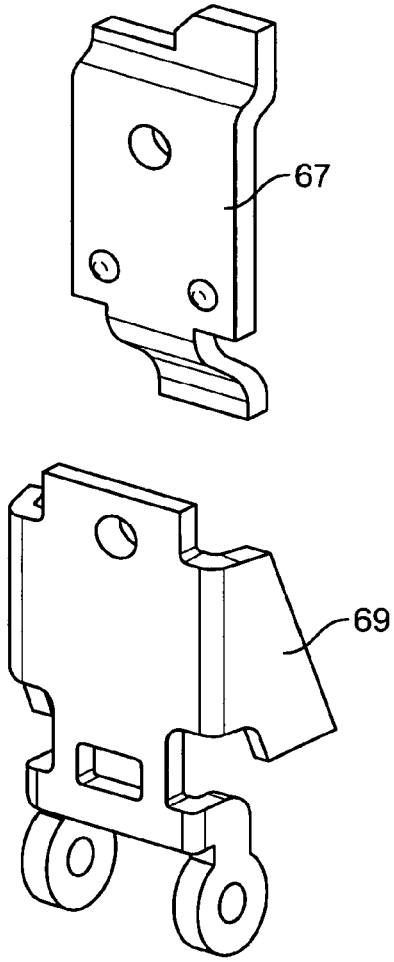
FIG. 6 is an isometric view of the back plate and the front plate of FIG. 5 separated.

FIG. 6 is an isometric view of the back plate 67 and the front plate 69 of FIG. 5 shown in a separated condition. The illustrated front plate 69 might be used with the arrangement of either FIG. 4 or FIG. 5.

Figure 7:
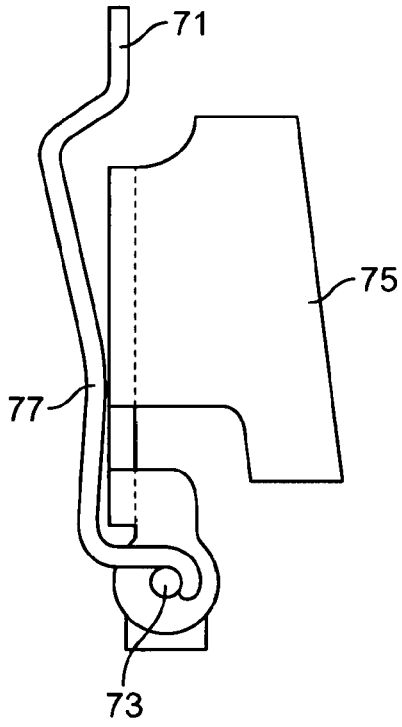
FIG. 7 shows an alternate means of connecting the back plate to the front plate of the armature.

FIG. 7 shows an alternate means of connecting the back plate to the armature whereby a spring element back plate 71 comprising a formed metal element is hinged about the same pivot pin 73 as the front plate 75 and makes contact with the front plate 75 through its spring tension at a bend in the back plate 71 serving as a fulcrum point 77. The set screw 55 of FIG. 2 is thus eliminated. It will be noted that a magnetic air gap adjustment screw, a mounting plate, and the clearance adjustment screw 47 are not shown in this figure for convenience of illustration but are normally present for operation.

Figure 8:
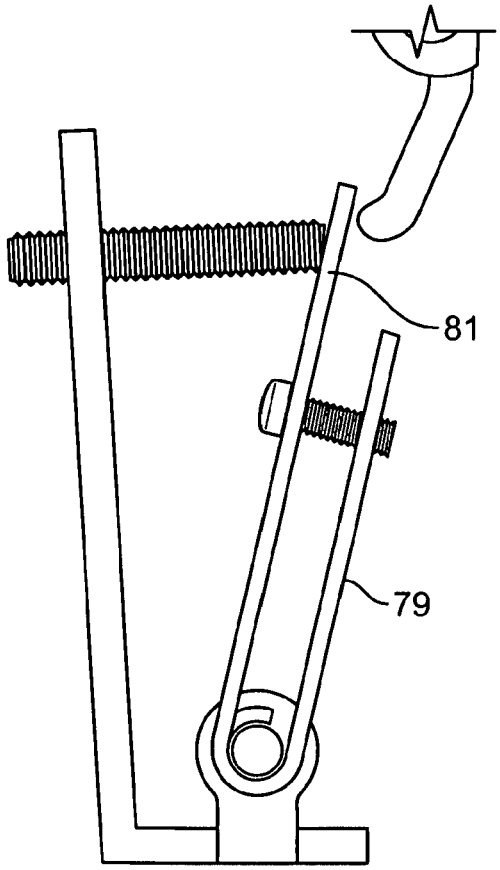
FIG. 8 illustrates an embodiment where the front plate and the back plate have been embodied as one flexure element.
Figure 9:
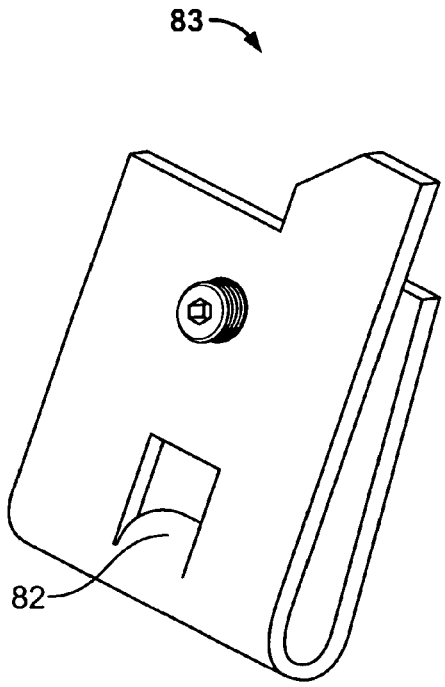
FIG. 9 shows an armature with a first way of retaining a pivot pin or boss for the armature.
Figure 10:
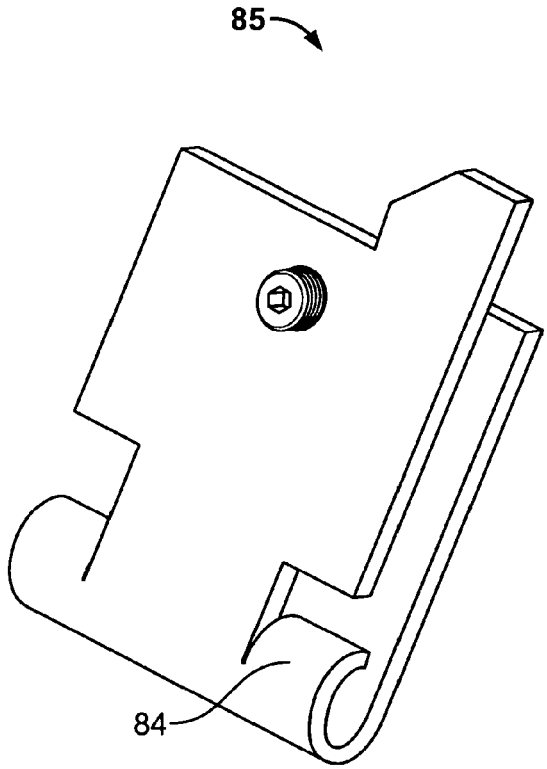
FIG. 10 shows an armature with an alternate way of retaining a pivot pin or boss.

In FIG. 8 the front plate 79 and the back plate 81 of a divided armature 83 have been formed from one flexure element. The front plate 79 may be flat without any formed pole faces. FIGS. 9 and 10 show alternate means 82, 84 of retaining a pivot pin (not shown) within single piece armatures 83, 85, respectively, by formed cut outs in the bight of the flexure bent to retain the pivot pin.

Figure 11:
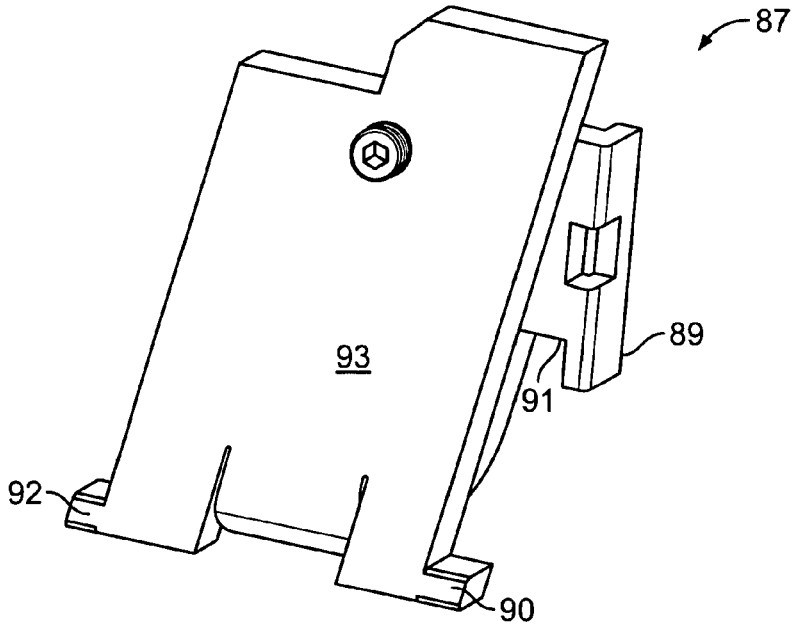
FIG. 11 shows in perspective an alternate construction of FIG. 8 with the front plate having formed pole faces and a hinge comprising two coined corners on the back plate.
Figure 12:
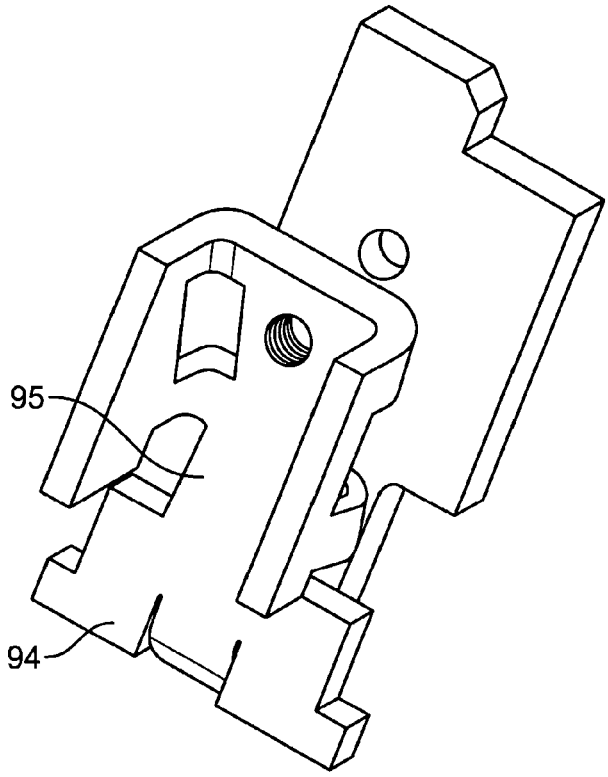
FIGS. 12 and 13 show front and back perspective views, respectively, with the pivot located on the front plate.
Figure 13:
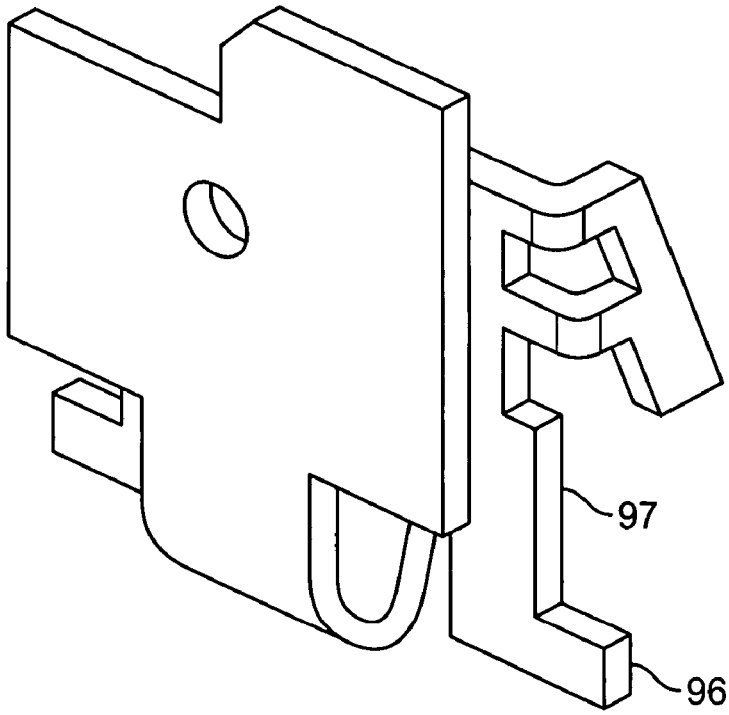

FIG. 11 shows an alternate construction with a divided armature 87 formed from a single piece of metal and having at least one formed pole face 89 on the front plate 91. The hinge consists of two coined corners 90, 92 on the back plate 93. FIGS. 12 and 13 show perspective views of similar constructions but with pivots 94, 96 located on the front plates 95, 97, respectively.

Figure 14:
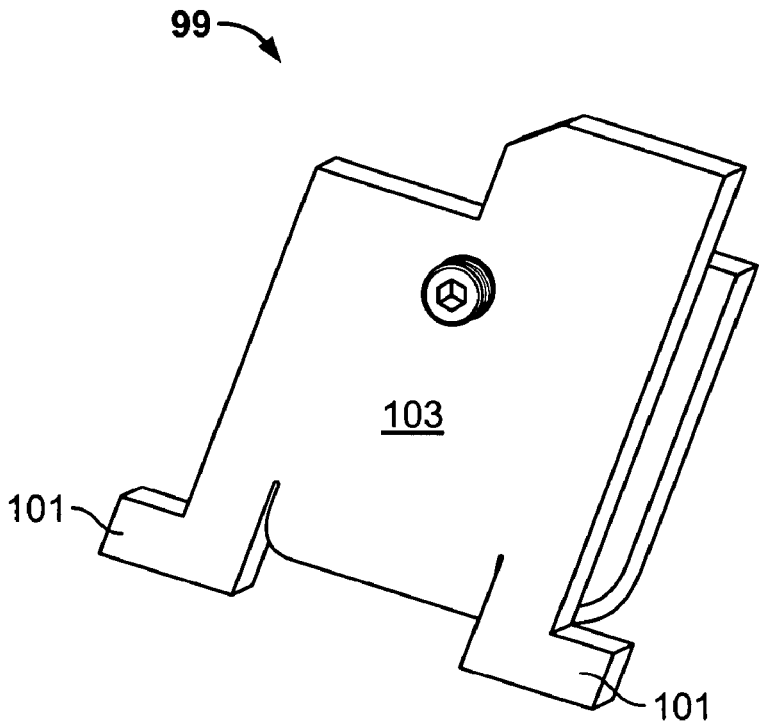
FIG. 14 is a variation of FIG. 8 but with a coined pivot like FIG. 11.

FIG. 14 shows a divided armature 99 formed from a single piece of metal and having coined pivots collectively 101 extending from the back plate 103. This embodiment is similar to that of FIG. 11 but without the formed pole faces.

FIG. 15 shows an embodiment of the armature 107, where a return spring 111 acts directly on the back plate 115. A lanced or stamped and formed spring element 117 keeps the back plate 115 and the front plate 119 pre-loaded.

This divided armature system can be applied to any device that is based on an electromagnetic actuation principle. This includes, but is not limited to, tripping systems and accessories of circuit breakers, relays, actuators. Having thus described a divided armature for an electromechanical actuator; it will be appreciated that many variations thereon will occur to the artisan upon an understanding of the present invention, which is therefore to be limited only by the appended claims.

We claim:

1. In a trip assembly with an armature electromagnetically attractable to a yoke, whereby the armature can be driven towards the yoke to release a trip bar, and with a return spring operably interacting with the armature for resetting the trip assembly, the improvement comprising:

the trip assembly having a) a divided armature included within the trip assembly, the armature having:

i) a ferromagnetic front plate having a surface facing towards the yoke, and ii) a back plate comprising a spring element adjustably settable in a fixed position relative to the front plate, for impinging on the trip bar to initiate the opening of a circuit;

b) a first adjustment linkage for adjustably setting a magnetic air gap between the yoke and the front plate; and c) whereby an adjustment of the first linkage does not materially effect the operating tension of the return spring.

2. The trip assembly of claim 1 wherein: the back plate is facing the front plate opposite that front plate surface facing toward the yoke.

3. The trip assembly of claim 1 wherein: the first adjustment linkage is a first adjustment screw.

4. The trip assembly of claim 1 further comprising a second linkage for setting a clearance between the back plate and the trip bar.

5. The trip assembly of claim 4 wherein: the second linkage is a second adjustment screw.

6. The trip assembly of claim 1 further comprising: a set screw between the two plates for fixing the distance therebetween.

7. The trip assembly of claim 3 wherein: the front plate threadably receives the first adjustment screw which is contained within the back plate.

8. The trip assembly of claim 5 wherein: the second adjustment screw is threaded through a mounting plate and impinges on the back plate.

9. The trip assembly of claim 1 wherein: the front plate and back plate are pivotally mounted.

10. The trip assembly of claim 1 wherein: the front plate and back plate share the same pivot arm.

11. The trip assembly of claim 1 wherein: the armature is formed from a one piece flexure.

12. The trip assembly of claim 1 wherein: the front plate has a formed face with extensions protruding towards the yoke and the back plate lies at least partially between said extensions.

13. The trip assembly of claim 1 wherein: the return spring applies force to the armature through a bell crank.

14. In a circuit breaker having a trip assembly with an armature electromagnetically attractable to a yoke, whereby the armature can be driven towards the yoke to release a trip bar, and with a return spring for resetting the trip assembly, the improvement comprising:

the trip assembly having a) a divided armature on a mounting plate included within the trip assembly having:

i) a ferromagnetic front plate having a surface facing towards the yoke and ii) a back plate comprising a spring element attached to the front plate opposite the surface facing toward the yoke, for impinging on the trip bar to initiate the opening of a circuit;

b) a first adjustment screw between the front plate and the back plate for adjustably setting a magnetic air gap between the yoke and the front plate; and c) a second adjustment screw between the back plate and the mounting plate for adjustably setting a clearance between the back plate and the trip bar;

d) whereby an adjustment of the first screw does not materially affect the operating tension of the return spring.

15. The circuit breaker of claim 14 further comprising: a set screw between the two plates for fixing the distance therebetween.

16. The circuit breaker of claim 14 wherein: the front plate threadably receives the first adjustment screw which is contained within the back plate for setting the clearance between the back plate and the front plate.

17. The circuit breaker of claim 14 wherein: the second adjustment screw is threaded through the mounting plate and impinges on the back plate for setting the clearance between back plate and the trip bar.

18. The circuit breaker of claim 14 wherein: the front plate and back plate are pivotally mounted.

19. In an electromagnetic actuator with an armature electromagnetically attractable to a yoke, whereby the armature can be driven towards the yoke to initiate further action, and with a return spring operably interacting with the armature for resetting the actuator, the improvement comprising:

a) the armature having:

i) a ferromagnetic front plate having a surface facing towards the yoke, and ii) a back plate adjustably settable in a fixed position relative to the front plate, for impinging on a mechanism for initiation of the further action;

iii) at least one of the front and back plates comprising a spring element;

b) a first adjustment linkage for adjustably setting a magnetic air gap between the yoke and the front plate; and c) a second adjustment linkage for adjustably setting a clearance between the back plate and the mechanism for initiation of the further action;

d) whereby an adjustment of the first linkage does not materially effect the operating tension of the return spring.

* * * * *